US005188582A

United States Patent [19]

Ullman

[11] Patent Number: 5,188,582

[45] Date of Patent: Feb. 23, 1993

[54] APPARATUS FOR FORMING TEAR TAB LINING MATERIAL

[75] Inventor: Myron Ullman, Canfield, Ohio

[73] Assignee: Boardman Molded Products, Inc., Youngstown, Ohio

[21] Appl. No.: 708,647

[22] Filed: May 31, 1991

[51] Int. Cl.[5] ..... B65H 45/12

[52] U.S. Cl. ..... 493/440; 493/439; 493/447; 493/456

[58] Field of Search ..... 493/409–410, 493/416, 436, 438–440, 446–447, 455–456, 458, 248

[56] References Cited

U.S. PATENT DOCUMENTS

| | | | |
|---|---|---|---|
| 1,992,179 | 2/1935 | Blosser et al. . | |
| 2,132,340 | 6/1935 | Grupe . | |
| 2,245,348 | 6/1941 | Laver | 493/438 X |
| 2,868,539 | 1/1959 | Koons et al. . | |
| 2,908,494 | 5/1957 | Brodie . | |
| 3,012,603 | 12/1961 | Newsome et al. . | |
| 3,054,242 | 9/1962 | Harrison et al. | 493/440 X |
| 3,216,720 | 7/1962 | Sano . | |
| 3,245,680 | 4/1966 | Harrison et al. . | |
| 3,296,986 | 1/1967 | Gansl | 493/440 X |
| 3,351,339 | 11/1967 | Beard et al. . | |
| 3,534,954 | 10/1970 | Lynch, Jr. | 493/438 X |
| 3,546,768 | 12/1970 | Acton et al. . | |
| 3,579,876 | 5/1971 | Freermann | 493/440 X |
| 3,942,782 | 3/1976 | Harmach . | |
| 4,258,520 | 3/1981 | Rehbein . | |
| 4,420,148 | 12/1983 | Meadows . | |
| 4,502,675 | 3/1985 | Clark et al. . | |
| 4,544,080 | 10/1985 | Wright et al. . | |
| 4,582,743 | 4/1986 | Bahring . | |
| 4,726,578 | 2/1988 | Hickman et al. . | |
| 4,746,387 | 5/1988 | Wright et al. . | |
| 4,754,890 | 7/1988 | Ullman et al. . | |
| 4,822,326 | 4/1989 | Ullman et al. . | |
| 4,915,679 | 4/1990 | Gotou | 493/248 X |

FOREIGN PATENT DOCUMENTS

| | | |
|---|---|---|
| 2327161 | 10/1975 | France . |
| 480238 | 10/1969 | Switzerland . |

*Primary Examiner*—Bruce M. Kisliuk
*Assistant Examiner*—John A. Marlott
*Attorney, Agent, or Firm*—Browdy and Neimark

[57] ABSTRACT

An apparatus for forming thin plastic, film, aluminum, paper, glassine and other similar material into a double folded "z" shape as shown and described. In this apparatus, a first ramp folds the material initially in one direction, and a continuously variable die forms the second bend of a "z" shape of the material edge. In order to maintain accuracy, an initial crease is placed at the location of the first fold. The material is drawn through the die by any suitable roller or drawing means which can pull the material through the die. There are no rollers within the edge forming die.

8 Claims, 4 Drawing Sheets

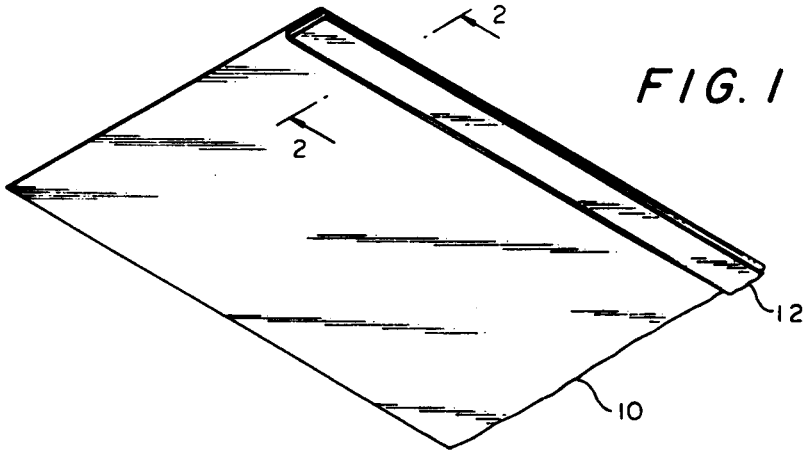
FIG. 1
FIG. 2
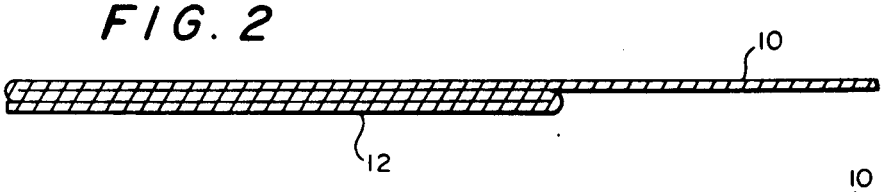
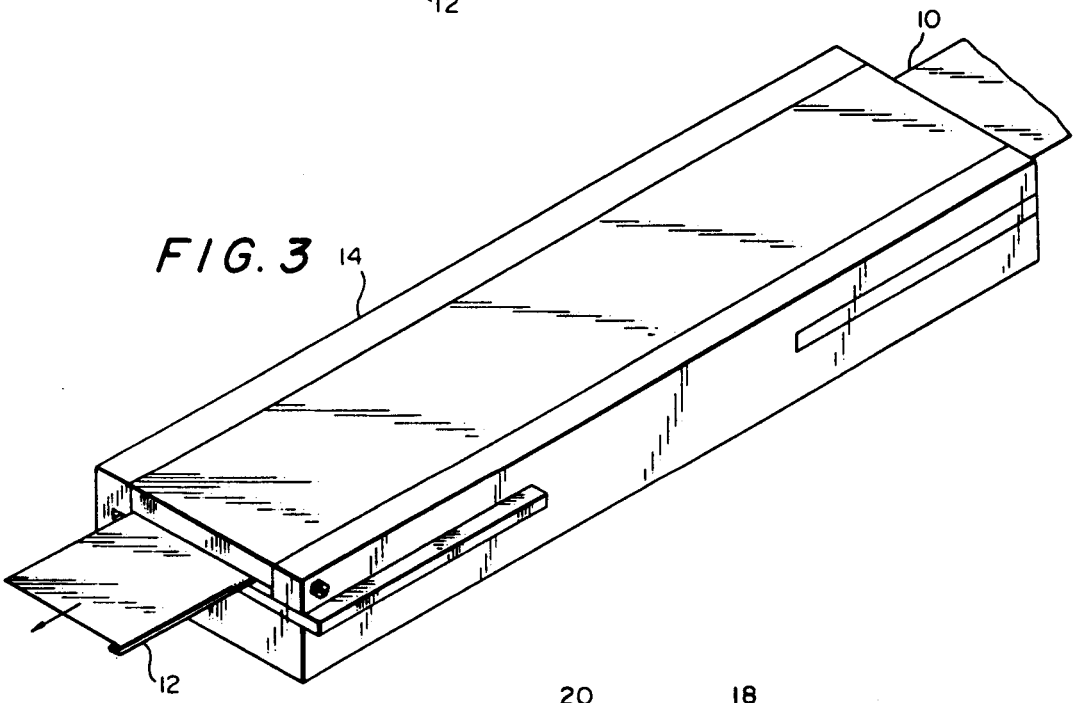
FIG. 3
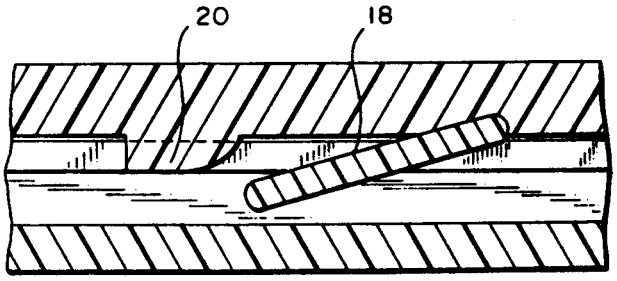
FIG. 5

APPARATUS FOR FORMING TEAR TAB LINING MATERIAL

FIELD OF THE INVENTION

This invention is in the field of folding edges of material such as aluminum, paper, glassine and like materials. A "z" or "s" shaped edge is folded along a lengthwise edge in order to form a tear tab or reinforced edge such as for a tamper evident safety seal for a bottle, jar or tub.

BACKGROUND OF THE INVENTION

The Ullman et al U.S. Pat. No. 4,754,890 relates to a Tamper Evident Safety Seal such as one of the type used to seal the opening in a medicine bottle, the seal having a pull-tab formed by double folding a web of sealing material prior to punching a seal therefrom. Ullman et al U.S. Pat. No. 4,822,326 is directed to the method.

In prior art devices there are numerous examples of forming a fold on the edge of a longitudinal strip by folding the edge over with the aid of rollers. There are also devices known as "plows" which serve to roll an edge upward and over in order to form an edge on a material, as is illustrated in U.S. Pat. No. 3,012,603 Newsome et al. Also known in the prior art is a method of folding a material whereby the material is pulled into a straight die and gradually creased and folded in the die in a continuous manner whereby the folded material is pulled from the exit end of the die (see U.S. Pat. No. 4,582,743, relating to toilet paper).

In prior art devices, there has been a failure to accomplish one or more of the following objectives:

(1) Face wrinkles on the product must be eliminated.

(2) A smooth unwrinkled finish must be obtained.

(3) The fold and refold must be in the shape of a "z" with the total width and the folded outer edge being at the same point.

(4) The fold must be continuous with no interruptions.

(5) There should be no puckering or unevenness in the folded edge.

(6) The material must move through the apparatus with a minimum of effort and a minimum of pull.

(7) There must be no scratching or groove formation in the final surface of flat areas of the part in order to maintain appearance.

(8) The shaping apparatus must be constructed to have a minimum length.

(9) The apparatus must be able to fold both sides of the film when required, either by placing two sections of the device in series, or one section with folding operation on both sides of the material simultaneously.

BRIEF SUMMARY OF THE INVENTION

This invention provides an apparatus for folding and refolding a continuous "z" edge on a strip or web of material where that material is of a thin, e.g. plastic, film, aluminum, paper or glassine-material.

It is thus an object to this invention to overcome deficiencies in the prior art, such as mentioned above, and another object to provide a folding apparatus which satisfies many or all of the requirements which the prior art, including that noted above, has been unable to meet.

In the present invention, the folding takes place in a series of steps or stations within a folding apparatus. The folding apparatus uses ramps or shoes formed, preferably molded, of slippery material such as high density polyethylene or polytetrafluoroethylene, and contains no rollers for folding, but may use rollers later only to compress the "v" shaped edge after it has left the folding apparatus.

The folding apparatus contains no dry rollers or other means to hold the material as it passes through the folding apparatus. The material is pulled through the folding apparatus by tension applied to the material at its output end. For this reason, the drag or friction produced against the material must be limited to an amount less than that which causes tearing, ripping, stretching or other undesirable distortion of the sheet material when the material is pulled through the apparatus.

The present apparatus also induces a series of folds including an initial indentation which establishes the location of all of the folds in the sheet of the material. Still further, a first fold is used to establish position within the die so that subsequent down stream folds are accurately located with respect to the edge of the material, thereby providing an even outer edge and constant "z" shaped fold. The present apparatus comprises, a first station at a first location for folding the sheet of material at a line parallel to an edge, a second station for providing a second fold which is in an opposite direction of the first fold, and a third station for continuously decreasing the angle of the first and second folds until folded the material web approximates a flat "z" shaped edge fold.

The present apparatus also include a fourth station located between the first and second stations for folding a first angle which is greater than 90° and which produces a fold with an apex at an acute angle. A fifth station may be located prior to the first station for making an indent in the material whereby a line is established for making the first fold and the indent establishes alignment of the material with respect to the first folding means.

This apparatus uses a fold-down ramp as the first station which folds at the crease from the upstream fifth station where the indent is formed.

The present apparatus can be used in conjunction with a sixth station comprising opposing rollers which hold and press the folds together. This station is located downstream from the folding apparatus, and serves only the purpose of compressing or flattening the edge further.

In this apparatus, the location of the apex of the corners of the "z" shape are established initially in the folding stations, and then the material is gradually formed by transition into the final "z" shape.

In this apparatus, a relative long lead into the folding area is provided so that the film will not wrinkle when pulled into subsequent folding operations within the apparatus. After the initial lead in, a crease or indent marks material at the location of the first fold. Next, the material is folded down to an approximately 90° angle at a second location. After the initial fold is established, there is a gradual transition in subsequent steps which form the second fold of the "z" and which compress the "z" to a position where the top and bottom and middle of the "z" are essentially parallel.

Other objects and the nature and advantages of the present invention will be more apparent from the following detailed description of an embodiment taken in conjunction with the drawing wherein:

DESCRIPTION OF THE DRAWINGS

FIG. 1 shows a fold continuously along the edge of a thin material which is produced with the apparatus of this invention.

FIG. 2 shows a cross-sectional view of a finish edge of material where the "z" shape of the material edge is seen.

FIG. 3 shows an overall perspective view of the folding apparatus of this invention where the material is drawn through in the direction of the arrow.

FIG. 5 shows a cross section of the lengthwise fold down ramp and the finger for creasing the material at the right angle.

DETAILED DESCRIPTION OF THE PREFERRED EMBODIMENT

In FIG. 1 there is shown the finished product 10 having a "z" or double folded edge 12. In this product, the edge must be smooth, free of wrinkles, should not be scratched by grooves in the forming apparatus, and must be folded tightly as shown in FIG. 2.

In FIG. 3 there is shown the overall folding apparatus in accordance with this invention where the material 10 is fed to the folding apparatus 14 and removes as a finished folded edge 12.

Figure 4:
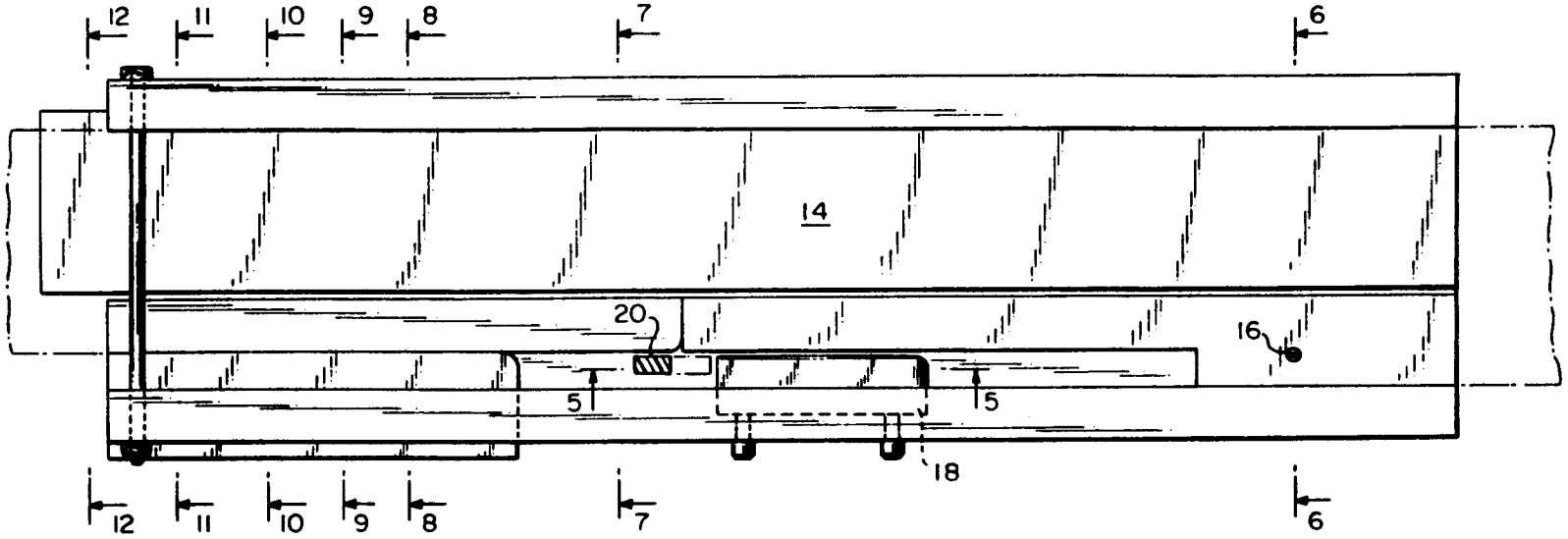
FIG. 4 shows a top view of the apparatus in FIG. 3 and identifies along its length various cross-sections which are shown in FIGS. 5-12.
Figure 6:
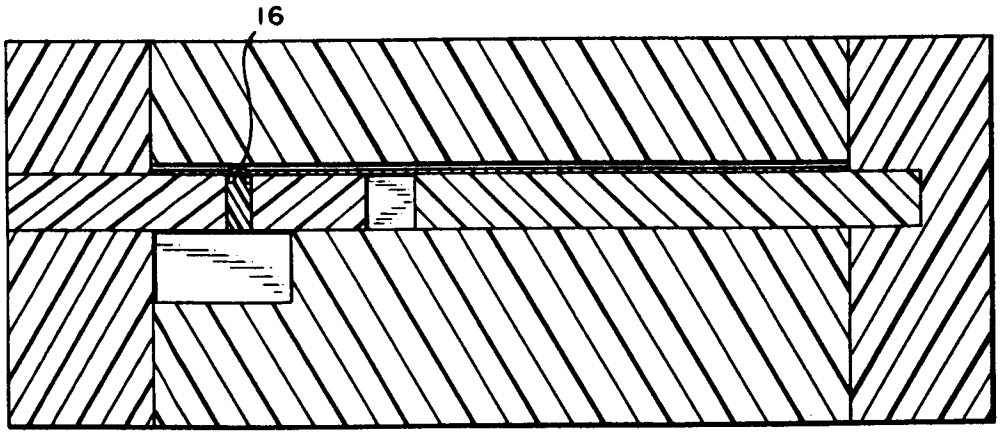
FIG. 6 shows a cross section along arrow 6—6 of FIG. 4.
Figure 7:
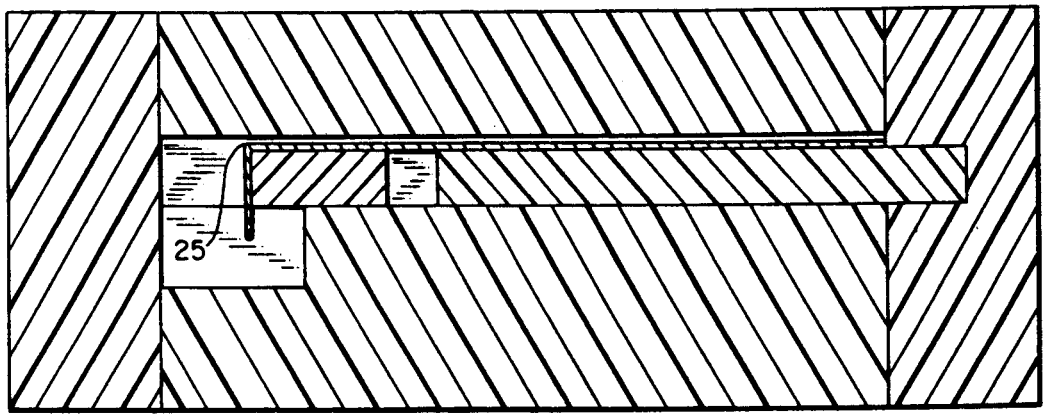
FIG. 7 shows a cross section along arrow 7—7 of FIG. 4.

In FIG. 6 there is shown a cross section of the apparatus taken along lines 6—6 in FIG. 4. The material 10 is fed into the apparatus 14 and when it reaches indent 16 a small indentation in the material is created as it passes beneath indent 16 as shown in FIG. 6. As the indented material downstream from indent 16 slides through the apparatus it next encounters a folding means 18 in the nature of a folding ramp for first folding the material as shown in FIG. 5, which is a cross section along lines 5—5 of FIG. 4. The folding ramp 18 produces a first fold in the material 12. After the material passes through fold down ramp 18, it passes beneath a pressure finger 20 which produces a tight sharp fold along the edge formed by indent 16 as shown in FIG. 7. The pressure finger 20 also produces a sharp crease along the edge of the fold as it passes beneath the finger 20.

In FIG. 7 there is shown a cross section taken along lines 7—7 of FIG. 4. FIG. 7 shows the strip material after it has passed beneath the pressure finger 20 and prior to forming of the second bend of the "z" shaped edge.

Figure 8:
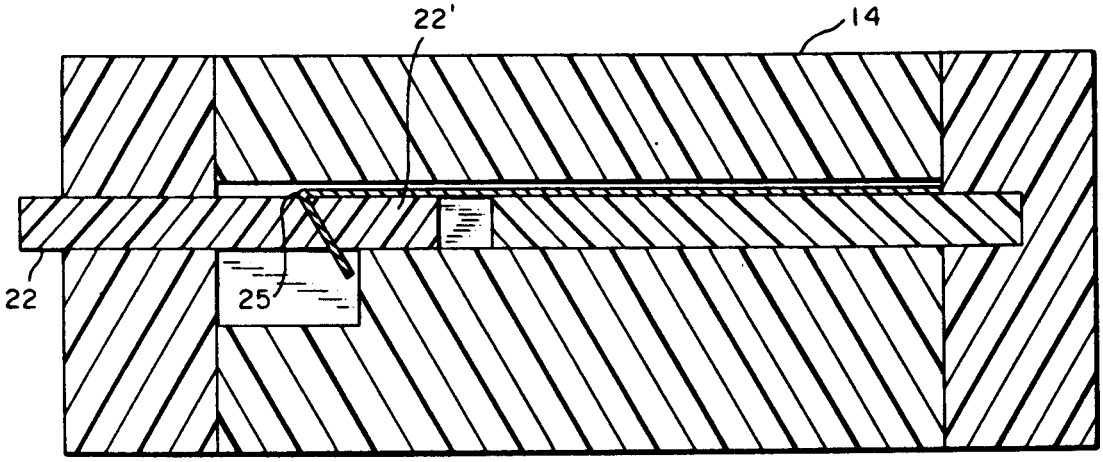
FIG. 8 shows a cross section along arrow 8—8 of FIG. 4.

In FIG. 8 there is shown a cross section shown along line 8—8 of FIG. 4. In this cross-section, there is shown die 22 which with its spacing die 22' increases the degree of the fold of the material 12 to lesser than 90°, or from an obtuse to an acute angle. This step in the folding by producing the acute angle further stabilizes the position of the material 12 in the apparatus 14. As such position is stabilized, accuracy of location of still to come folding steps are ensured.

Figure 9:
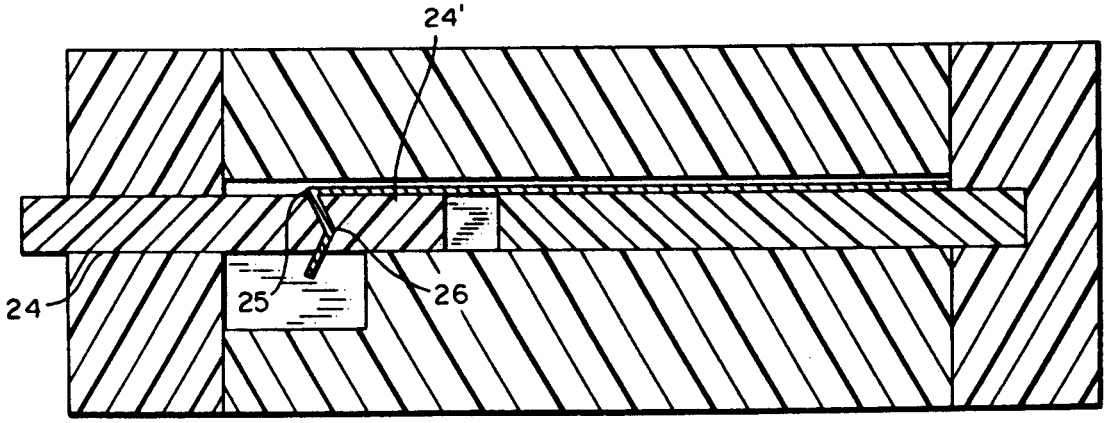
FIG. 9 shows a cross section along arrow 9—9 of FIG. 4.

In FIG. 9 there is shown a cross section along lines 9—9 of FIG. 4. When the material reaches this position, die 24 and die 24' have begun to establish the second fold in the material 26.

Figure 10:
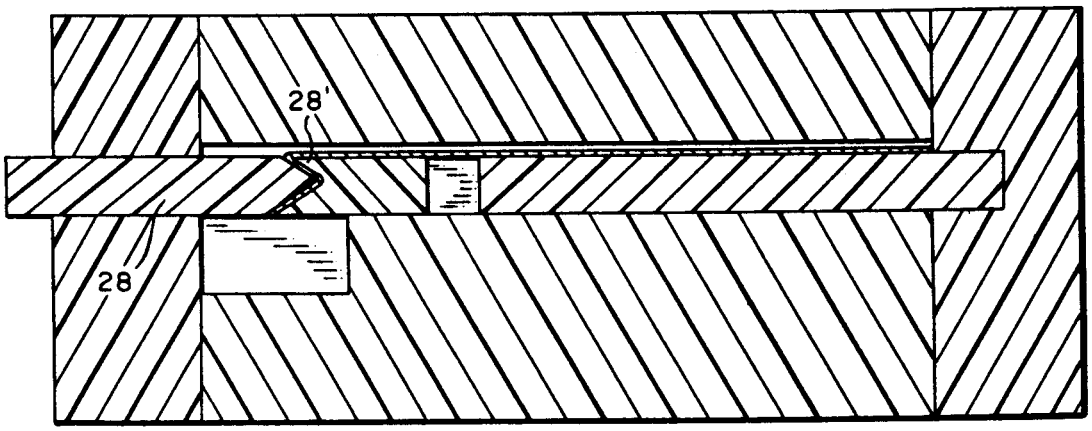
FIG. 10 shows a cross section along arrow 10—10 of FIG. 4.

In FIG. 10 there is shown a cross section along lines 10—10 of FIG. 4. Here, the die 28 and the die 28' produce a more acute angle having a v shape along fold 26 as shown.

Figure 11:
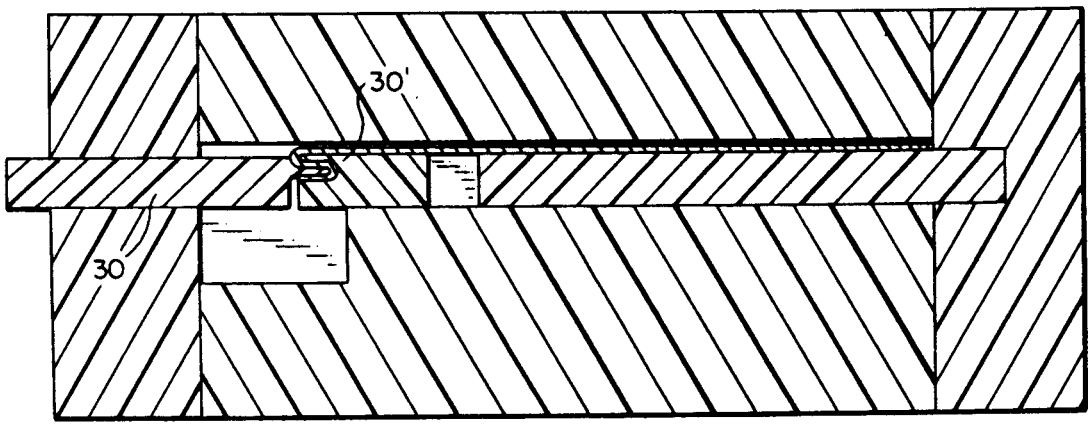
FIG. 11 shows a cross section along arrow 11—11 of FIG. 4.

In FIG. 11 there is shown a cross section of the apparatus 14 taken along line 11—11. In this position, die 30 cooperates with die 30' to produce an "s" or z shape in the material. It is to be understood that as the material moves from the location of FIG. 7 and through the cross sections shown in FIGS. 8, 9, 10 and 11, that the transition from one cross section to the next is a smooth and gradual transition. The profile of the material is generated by 14, 24, 28 and 30.

Figure 12:
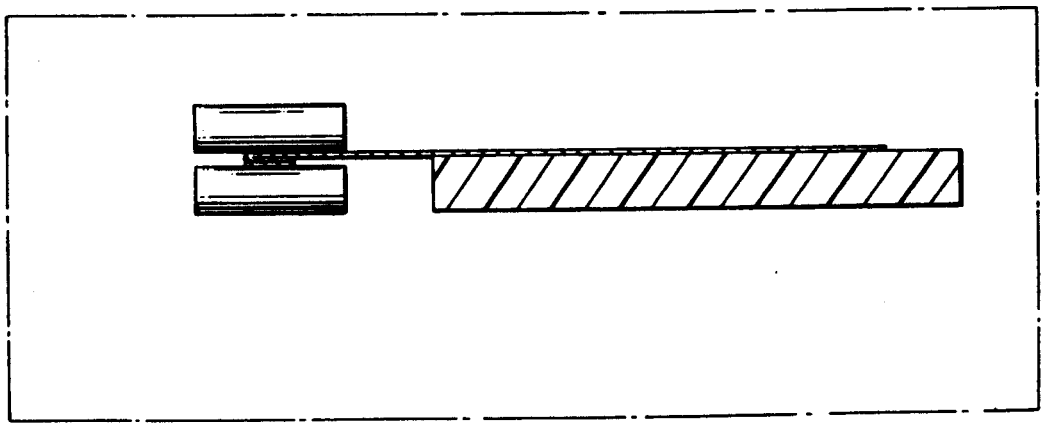
FIG. 12 shows a cross section along arrow 12—12 of FIG. 4.

Finally, in FIG. 12 which is a cross section taken after the folding operation is completed, there is shown the "z" shape portion of FIG. 11, material 12 in a crushed down or tightly folded position. This may be facilitated by the use of a pair of rollers or other pressing means which can press material more tightly together after it leaves the folding apparatus 14. In the present device, the folds 26 and 25 are established where the outside of the apex of the fold is not in contact with die surfaces such as 22, 22'. For some materials, it may be that the final crease or tight, sharp fold is not produced until the material leaves the die and enters into the rollers at location 12 as can be seen in FIG. 4. For other materials tight, short folds may be produced by the die alone.

The cross section beginning at lines 8—8 of FIG. 4 and those cross sections that follow are a combination of angular sides, each progressing in the direction of flow of the material but with each working in a different plane of the material.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An apparatus producing a first fold and a second fold forming a continuous "z" edge on a continuous web of thin material as it is pulled therethrough, comprising:

a first station for first folding said web material at a line parallel to an edge thereof in a first direction with respect to a first plane of said web material at a first angle with respect to a second plane defined by an unfolded portion of said web material;

a second station for second folding said web material at a second angle at a location on said first plane of said web material which is parallel to said edge and wherein said second fold is in a direction opposite to said first direction of said first fold;

a third station for continuously and gradually decreasing the angle of said first fold and said second fold until said web material forms a flat "z" shaped edge fold;

wherein said third station comprises angular sides forming different planes each progressing in a direction that said web material is pulled through said apparatus and each working on a different plane of said material; and wherein said third station has an upstream cross section in the form of a "v" and a downstream cross section in the form of a "z" and wherein there is a gradual transition from said "v" cross section to said "z" cross section; and an apex of said "v" cross section faces said unfolded portion.

2. The apparatus in accordance with claim 1 further comprising a fourth station located between said first and second station for increasing said first angle so that it is less than 90° to said unfolded portion and whereby said web material forms an acute angle having its apex at said first fold.

3. The apparatus in accordance with claim 1 further comprising a fifth station located before said first station for making an indent in said web material where said first fold is made by said first station.

4. The apparatus in accordance with claim 3, wherein said first station comprises a fold down ramp.

5. The apparatus in accordance with claim 1, wherein said first fold on said sheet establishes a reference which in combination with said first, second and third stations establish the location of said second fold.

6. The apparatus of claim 1 further comprising a sixth station having opposed rollers for forcing said first fold and said second fold together located downstream from said third station.

7. The apparatus in accordance with claim 1, wherein said first station comprises a pressure finger for providing a crease along said first fold.

8. The apparatus in accordance with claim 1, further comprising a section which collapses said "z" shape into a "z" shaped edge.

* * * * *